US009833758B2

(12) United States Patent
Ceccacci

(10) Patent No.: US 9,833,758 B2
(45) Date of Patent: Dec. 5, 2017

(54) VENTILATION SYSTEM FOR A MICRONIZER, IN PARTICULAR FOR WASHING MACHINES-STERILIZERS

(71) Applicant: OC S.r.l., Pontinia (IT)

(72) Inventor: Gerardo Ceccacci, Pontinia (IT)

(73) Assignee: OC S.r.l., Pontinia (IT)

( * ) Notice: Subject to any disclaimer, the term of this patent is extended or adjusted under 35 U.S.C. 154(b) by 0 days.

(21) Appl. No.: 14/952,925

(22) Filed: Nov. 26, 2015

(65) Prior Publication Data

US 2016/0151752 A1 Jun. 2, 2016

(30) Foreign Application Priority Data

Nov. 27, 2014 (IT) ..... RM2014A0688

(51) Int. Cl.

| | |
|---|---|
| ***B01F 3/04*** | (2006.01) |
| ***B01F 15/00*** | (2006.01) |
| ***F04D 13/06*** | (2006.01) |
| ***F04D 29/54*** | (2006.01) |
| ***F24F 13/20*** | (2006.01) |
| ***F24F 6/12*** | (2006.01) |

(52) U.S. Cl.

CPC .... *B01F 15/00993* (2013.01); *B01F 3/04021* (2013.01); *F04D 13/0606* (2013.01); *F04D 29/541* (2013.01); *F24F 6/12* (2013.01); *F24F 13/20* (2013.01); *B01F 2215/0077* (2013.01); *F24F 2221/18* (2013.01)

(58) Field of Classification Search

CPC ..... B01F 3/04021; B01F 15/00993; B01F 2215/0077; F04D 13/0606; F04D 29/541; F24F 6/12; F24F 13/20; F24F 2221/18

USPC ..... 261/30, 78.2

See application file for complete search history.

(56) References Cited

U.S. PATENT DOCUMENTS

| | | | | |
|---|---|---|---|---|
| 640,340 | A * | 1/1900 | Whaley | F24F 6/12 261/116 |
| 1,779,336 | A | 10/1930 | Champlain | |
| 1,807,032 | A | 5/1931 | Giesseler | |
| 2007/0216259 | A1* | 9/2007 | Kang | B05B 17/0615 310/353 |
| 2010/0225012 | A1 | 9/2010 | Fitton et al. | |
| 2011/0031636 | A1* | 2/2011 | Ediger | F24F 6/12 261/78.2 |
| 2012/0138049 | A1* | 6/2012 | Wachtel | A61M 11/06 128/200.14 |

(Continued)

FOREIGN PATENT DOCUMENTS

| | | |
|---|---|---|
| CN | 2893503 | 4/2007 |
| EP | 2306103 | 4/2011 |

OTHER PUBLICATIONS

Italian Search Report for Italian Application No. RM2014A000688, dated Jul. 17, 2015.

*Primary Examiner* — Charles Bushey

(74) *Attorney, Agent, or Firm* — Dann, Dorfman, Herrell and Skillman; Stephen Eland

(57) ABSTRACT

The present disclosure concerns a ventilation system to be applied to a micronizer, in such a way that the ventilation does not prevent nebulization, rather it disperses it in an environment that for example is to be sterilized. Thanks to a particular configuration, the ventilation system is also resistant to water present in the environment to be sterilized.

11 Claims, 4 Drawing Sheets

(56) References Cited

U.S. PATENT DOCUMENTS

2014/0131901 A1* 5/2014 Yen ..... F24F 6/12
261/72.1

* cited by examiner

VENTILATION SYSTEM FOR A MICRONIZER, IN PARTICULAR FOR WASHING MACHINES-STERILIZERS

CROSS REFERENCE TO RELATED APPLICATIONS

The present application claims priority to Italian patent application no. RM2014A000688 filed on Nov. 27, 2014. The entire disclosure of the foregoing application is hereby incorporated herein by reference.

FIELD

The present disclosure relates to a ventilation system for a micronizer, for example for washing machines-sterilizers, decontaminating washing machines, washing systems for isolators, glove boxes, C-rabs.

More in detail, the present disclosure concerns a ventilation system to be applied to a micronizer, in such a way that the ventilation does not prevent nebulization, rather it disperses the nebulization in an environment that for example is to be sterilized. Thanks to a particular configuration, the ventilation system is also resistant to water present in the environment to be sterilized.

BACKGROUND

There are on the market micronizer devices that atomize a liquid solution in an environment. To increase the spread of the spray, common electric fans can be utilized, for example the micronizer can be placed vertical to the plane of rotation of a fan.

However, these prior art solutions are not suitable for environments in which there is a certain amount of water that can short-circuit the fan.

The replacement of the fan with a jet of compressed air from the bottom upwards which sweeps over the micronizer is not conceivable as well, because the water would tend to deposit on the mouth shooting compressed air.

The object of the present disclosure is to provide a ventilation device for micronizer which solves the problems and overcomes the drawbacks of the prior art.

It is further object of the present disclosure an atomizing system that makes use of the device object of the disclosure.

It is subject-matter of the present disclosure a device and a system such as in the attached claims, incorporated herein by reference.

BRIEF DESCRIPTION OF THE DRAWINGS

The subject-matter of the disclosure will be now described, by way of illustration but not by way of limitation, with particular reference to the drawings of the accompanying figures, in which.

DETAILED DESCRIPTION

Figure 1:
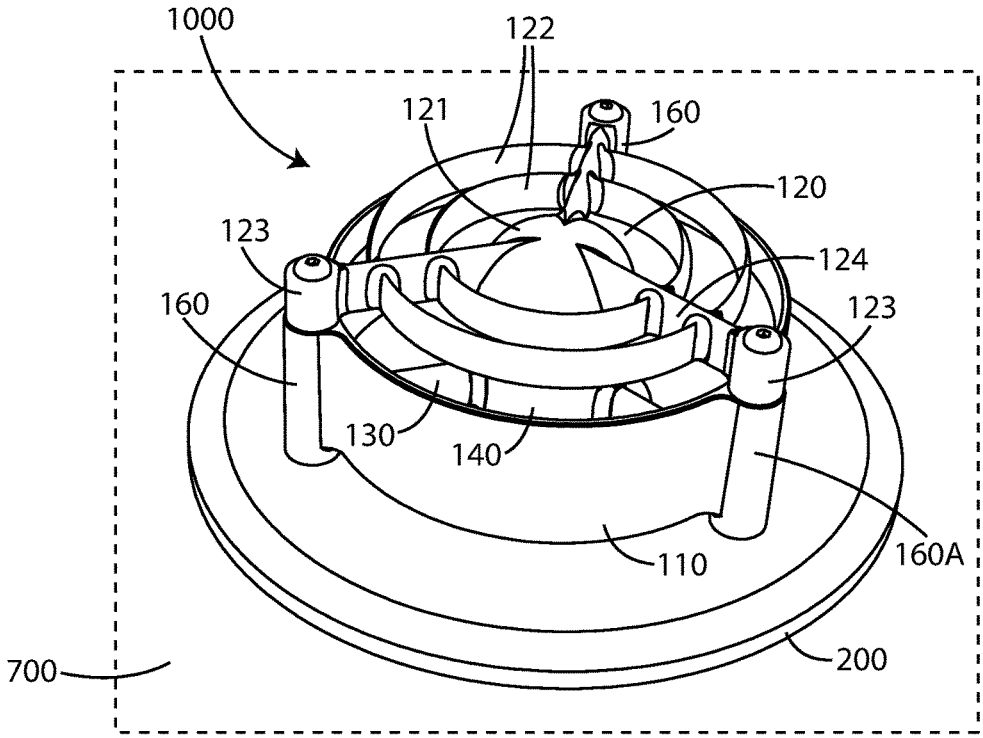
FIG. 1 shows a perspective view of an embodiment of the system according to the disclosure.
Figure 2:
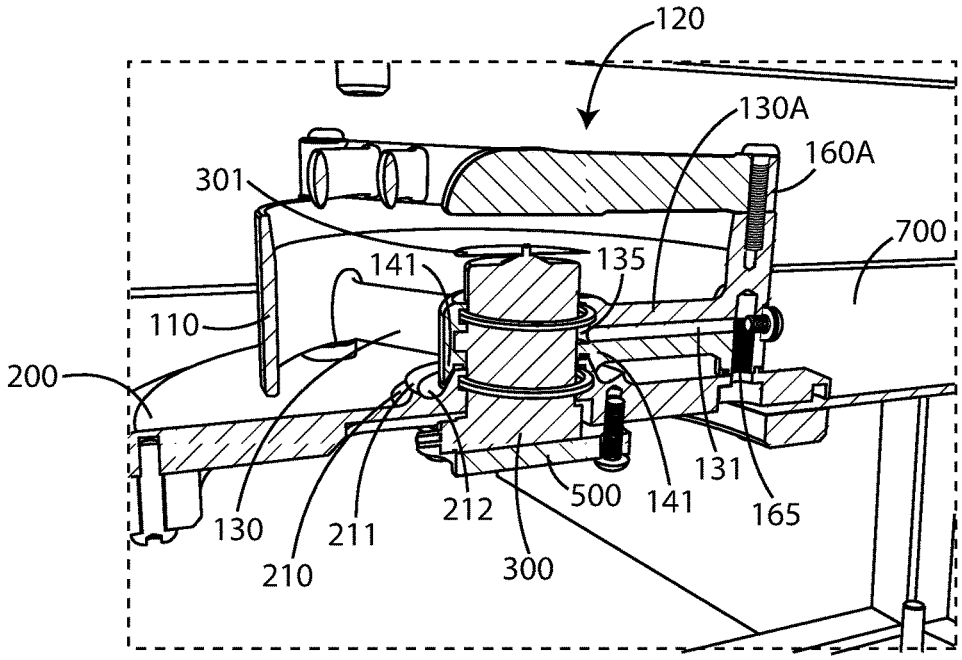
FIG. 2 shows a section of the system of FIG. 1.
Figure 3:
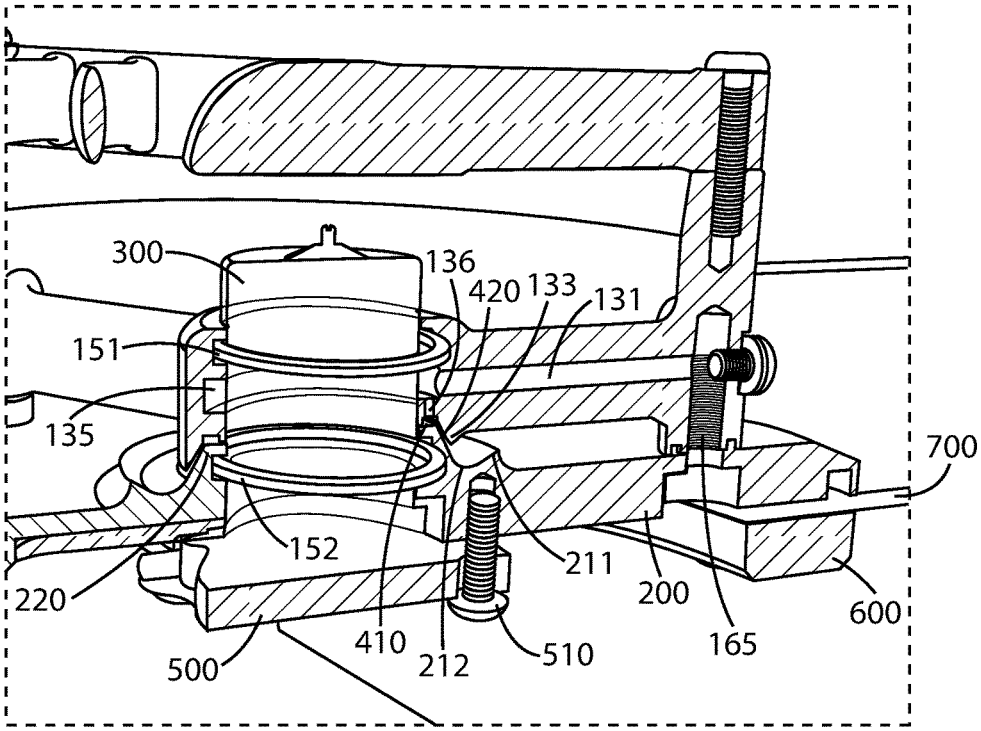
FIG. 3 shows a detail of FIG. 2.
Figure 4:
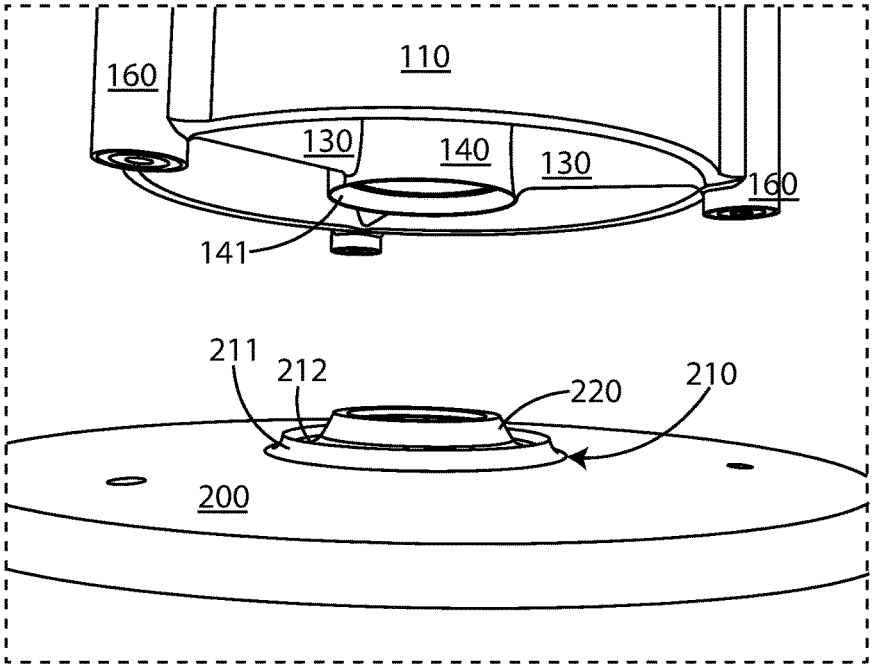
FIG. 4 shows a detail of a perspective view of the assembly of the system of the preceding figures.
Figure 5:
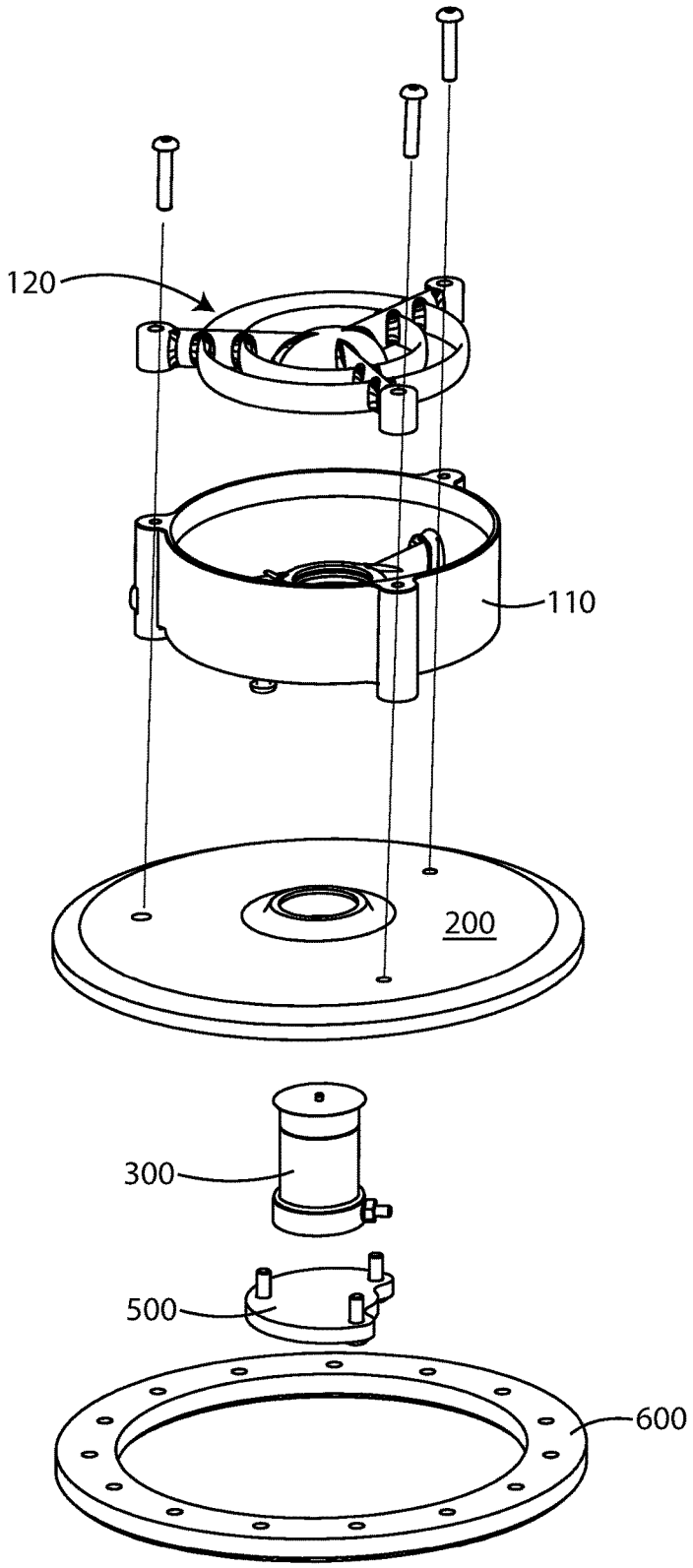
FIG. 5 shows a whole perspective view of the assembly of the system of the preceding figures.

Referring to the accompanying figures, the system 1000 includes a base 200 on which a frame 110 is placed with at least a vertical element 160, 160A (i.e. perpendicular to the base 200 which is typically flat). In the example of the figures, there are three vertical elements 160,160A placed at 120° from each other. One of these elements 160A is provided with a conduit 165 which leads from the bottom up to a certain height, and in which compressed air can be blown.

From one or more of these elements 160, a horizontal arm extends that leads into a central chamber at least partially occupied by the micronizer 300, which has a propeller 301 at its upper end (again with respect to the base 200 which is typically secured to the bottom 700 of a washing machine). The element 160A that comprises the duct 165 possess this arm, since in this case the arm also is holed, so that the air blown in at the base of the element 160A can reach the central chamber.

It is here to be specified that the vertical elements are not essential, because the air (e.g. compressed air) may be injected directly into said central chamber. The vertical elements 160 are preferred because they allow not to occupy space laterally but only under the base 200, thus maximizing the space available for the sterilization chamber of a washing machine, the base 200 being in this case the base of the washing machine.

It is now specified that the central chamber can be formed, according to the illustrated aspect of the disclosure, by a main frame or housing 140 connected to the frame 110 by the arms 130 (the central frame 140 can be formed in one piece with the ends of the arms). This central frame 140 is shaped so as to comprise a circular inner chamber 135 so that the air that arrives from the arm 130A circulates in this circular inner chamber 135. Said internal circular chamber 135 is delimited according to an aspect of the disclosure by two O-rings 151, 152 (or in general, watertight/fluid-tight means) placed one above the other in the vertical direction. The internal circular chamber possesses holes 136 which constitute channels that go downwards, i.e. towards the base 200. The air exiting from the holes 136 downwardly meets a bottom 212 surrounded by a relief or ridge 211 ("U"-like shape) so that air (or any other fluid suitable for the purpose) is forced to go upwardly, or at least partially in the direction perpendicular to the base 200. In this way, the air blown in will allow a ventilation upward that will spread the spray created by micronizer.

According to the shown aspect of the disclosure, the holes 136 end before the bottom 212, running into a further circular chamber 410 and subsequently into a slot 420 which is created between the lower edge 141 of the central frame 140 and a ridge 220 internal to said bottom 212 (accordingly a "U"-type gap). However it is clear that the most general essential feature is that of a conduit which from the internal circular chamber 135 brings air to strike against the bottom 212 and the ridge 211.

The element 500 is a plate that is fixed from below to the base 200 (for example by a bolt 510) to secure the micronizer within the central chamber.

The element 600 is a ring that allows the fixing of the frame 110 to the base 200, from below the base 200.

The element 120 is an optional cover frame, to protect the propeller 301 of the micronizer, fixable to the vertical elements 160 through corresponding radial ends 123 for fastening at the ends of cover arms 124 connected to a central cap 121. Curved arms 122 join the cover arms 124.

The path of the air is indicated by arrows in the drawings.

Figure 6:
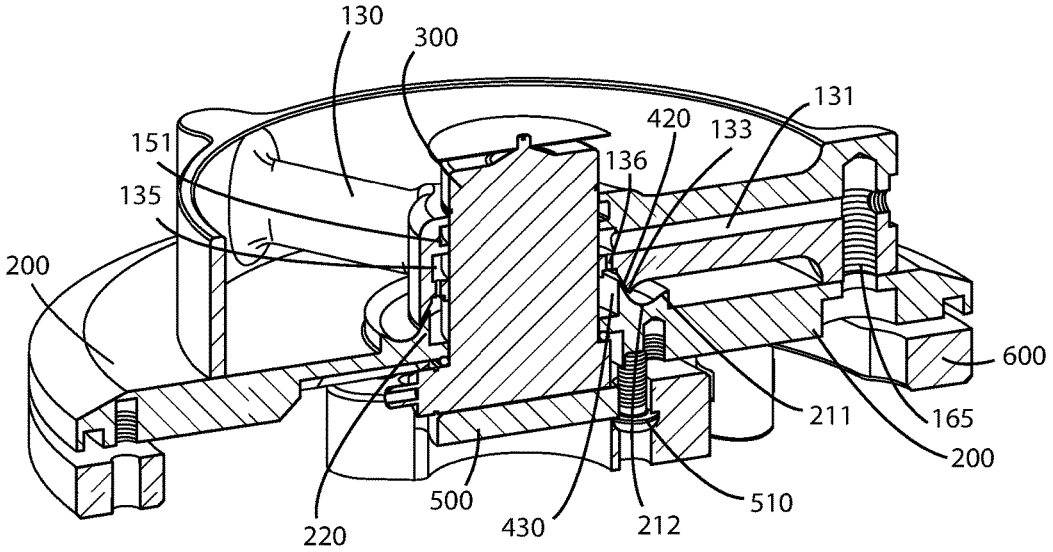
FIG. 6 shows a sectional view of a device according to a different aspect of the disclosure.

Referring to FIG. 6, the Inventor has found that even the distribution of air in the same ventilation system of the disclosure is considerably improved if a chamber 430 is added to the device of the preceding figures, in communication with the chamber 136 and having sufficient size to harmonize the pressure of the ventilation fluid.

It must be said that in all the aspects of the disclosure the conduit 420 can have a length (and a section) to be determined according to the type of used fluid, so that it is not quantifiable a priori. The conduit 420 may stop before or run along the valley 212 or end close to the ridge 211 according to the needs. Even the above-mentioned U-shape may be modified so as to optimize, by means of known simulation tools or by calculations and tests, the flow and the final distribution of the fluid.

In the foregoing aspects of the disclosure have been described and variants of the present disclosure have been suggested, but it is to be understood that those skilled in the art can make other variations and changes, without so departing from the related scope of protection, as defined by the appended claims.

What is claimed is:

1. Ventilation device for a micronizer with a body and an active part, utilizing a ventilation fluid, wherein the ventilation device comprises:

a base substantially on a first plane;

a first frame fixed to a side of said base and comprising a housing in which the body of said micronizer is partially insertable, in such a way that the active part of said micronizer extends above said housing in the direction perpendicular to said plane;

and wherein:

said housing is shaped in such a way to form, in use, with said micronizer, an internal perimetrical chamber;

said internal perimetrical chamber presents an entrance for said ventilation fluid;

said internal perimetrical chamber presents, along its extension, a plurality of holes which present an outlet opening towards said base, said base comprises a main hole into which said micronizer is partially insertable, said main hole presenting a perimetrical region with a radial section including from the inside to the outside:

a first ridge connected by an inclined surface to a bottom that is lower than the first ridge;

a second inclined surface connecting said bottom to a second ridge, in such a way to form an overall surface having a "U"-type section;

said frame comprises a portion facing said first inclined surface and forming with it an interspace through which, in use, said ventilation fluid exiting said plurality of holes can flow.

2. A device according to claim 1, wherein said internal perimetrical chamber is a circular chamber.

3. A device according to claim 1, wherein the holes of said plurality of holes end at a second perimetrical chamber in communication with said interspace.

4. A device according to claim 1, wherein said entrance of said internal perimetrical chamber is connected to a lateral channel, formed within a lateral arm connected to said housing, said lateral channel being apt, in use, to guide said ventilation fluid towards said internal perimetrical chamber.

5. A device according to claim 4, characterized in that said lateral arm is connected, at the end opposite to said housing, to a vertical element connected to said base and comprising a vertical channel in communication with said lateral channel, in such a way that, in use, said ventilation fluid can be introduced into said vertical channel from said base.

6. A device according to claim 1, wherein said housing is connected by one or more arms to respective one or more support vertical elements, perpendicular to said first plane and fixed to said base.

7. A device according to claim 1, wherein the device comprises a plate fixed to said base on the opposite side with respect to said housing in such a way to fix, in use, said micronizer.

8. A device according to claim 1, wherein above said housing and, in use, above said active part of said micronizer, in the direction perpendicular to said first plane, a protection mask is placed.

9. An atomization system, comprising a micronizer and a ventilation device, wherein the ventilation device is the device according to claim 1.

10. The device according to claim 1 wherein the ventilation device is configured to use air as a ventilation fluid.

11. The device according to claim 1 wherein the internal perimetrical chamber is on a second plane parallel to the first plane.

* * * * *